US009450324B2

(12) United States Patent
O'Neill et al.

(10) Patent No.: US 9,450,324 B2
(45) **Date of Patent: *Sep. 20, 2016**

(54) VEHICLE POWER CONNECTOR

(71) Applicant: O'Neill Components LLC, Eatonville, WA (US)

(72) Inventors: Darren O'Neill, Eatonville, WA (US); Steven O'Neill, Eatonville, WA (US)

(73) Assignee: O'Neill Components LLC, Graham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/730,065

(22) Filed: Jun. 3, 2015

(65) Prior Publication Data

US 2015/0357776 A1 Dec. 10, 2015

Related U.S. Application Data

(63) Continuation-in-part of application No. 14/296,362, filed on Jun. 4, 2014, now Pat. No. 9,203,174.

(51) Int. Cl.

| | |
|---|---|
| ***H01R 33/00*** | (2006.01) |
| ***H01R 13/447*** | (2006.01) |
| ***H01R 27/00*** | (2006.01) |
| ***H01R 24/86*** | (2011.01) |
| *H01R 13/52* | (2006.01) |
| *H01R 13/62* | (2006.01) |

(52) U.S. Cl.

CPC ..... *H01R 13/447* (2013.01); *H01R 24/86* (2013.01); *H01R 27/00* (2013.01); *H01R 13/5213* (2013.01); *H01R 13/62* (2013.01); *H01R 2201/26* (2013.01)

(58) Field of Classification Search

CPC ..... H01R 2201/26; H01R 13/5213; H01R 13/62

USPC ..... 439/142

See application file for complete search history.

(56) References Cited

U.S. PATENT DOCUMENTS

| | | | | |
|---|---|---|---|---|
| 6,749,438 | B1 * | 6/2004 | Scheller | B60D 1/62 439/35 |
| 7,845,974 | B2 * | 12/2010 | Yue | H01R 13/72 191/12.4 |
| 9,203,174 | B1 * | 12/2015 | O'Neill | H01R 24/86 |
| 2005/0176265 | A1 * | 8/2005 | Jacobs | H01R 13/502 439/35 |

OTHER PUBLICATIONS

United States Patent and Trademark Office, Non-Final Office Action, U.S. Appl. No. 14/296,362, mailed Jul. 9, 2015, 9 pages.

* cited by examiner

*Primary Examiner* — Abdullah Riyami
*Assistant Examiner* — Justin Kratt
(74) *Attorney, Agent, or Firm* — Perkins Coie LLP

(57) ABSTRACT

A power connector for a vehicle includes a receptacle with a central opening that can receive a cylindrical connector. Within the central opening are a center contact and a number of electrical contacts arranged in a generally circular configuration around the center contact. The receptacle further includes an extension area on either side of the central opening that hold one or more additional electrical contacts. A pair of covers are configured to open to expose the additional contacts and the center contact with the surrounding circular configuration of contacts. With both covers open, all the contacts in the receptacle are exposed.

20 Claims, 7 Drawing Sheets

VEHICLE POWER CONNECTOR

RELATED APPLICATION

The present application is a continuation-in-part of U.S. patent application Ser. No. 14/296,362 filed Jun. 4, 2014, which is herein incorporated by reference in its entirety.

TECHNICAL FIELD

The disclosed technology relates to vehicle connectors and in particular to connectors that provide electrical power from a vehicle to a trailer.

SUMMARY

The disclosed technology relates to improvements in power connectors for automotive and commercial vehicle use. In one embodiment, a power connector includes a receptacle and a corresponding plug with mating electrical contacts. The contacts include a standard configuration of a center contact and a number of additional electrical contacts that are oriented in a circle around the center contact. The power connector also includes a number of additional electrical contacts positioned outside the standard configuration of electrical contacts. In one embodiment, the additional electrical contacts include 4 contact blades that are symmetrically placed around the center contact.

The receptacle has a circular opening that accepts a cylindrical plug to mate with the standard configuration of electrical contacts. The receptacle has a pair of additional openings that extend on either side of the circular opening that are configured to receive a correspondingly shaped plug. The receptacle has a pair of cover flaps including a first cover flap that covers the additional electrical contacts and a second cover flap that covers the standard configuration of electrical contacts. With the second cover flap opened, the receptacle is configured to receive a standard cylindrical plug that mates with the standard configuration of electrical contacts. With both cover flaps opened, the receptacle is configured to receive a plug that mates with both the standard configuration of contacts and with the additional contacts.

DETAILED DESCRIPTION

Figure 1:
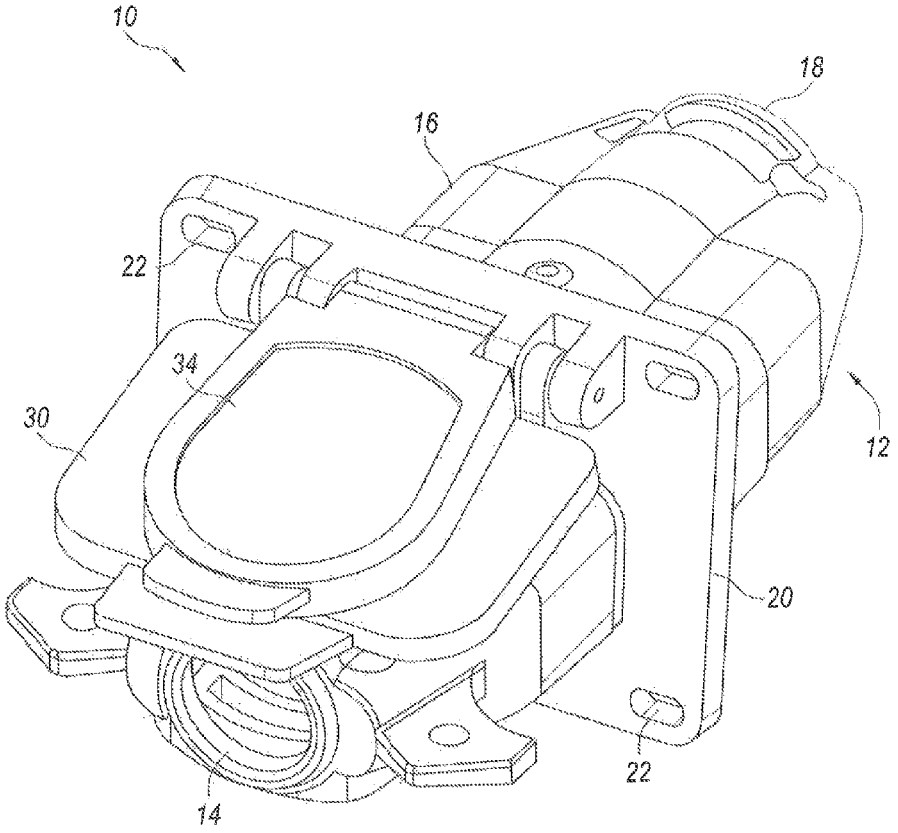
FIG. 1 is an isometric view of a vehicle power connector assembly in accordance with an embodiment of the disclosed technology.

An electrical connector in accordance with one embodiment of the disclosed technology is shown in FIG. 1. A connector 10 includes a receptacle 12 and a mating plug 14. The receptacle 12 has a body portion 16 with a first end into which electrical contacts are fitted and a second end that includes a strain relief 18.

The receptacle 12 has a generally rectangular faceplate 20 with holes 22 positioned in the corners to allow the faceplate to be secured to a surface of a vehicle. The faceplate is generally flush with an opening into the receptacle. A pair of spring loaded covers 30, 34 on the faceplate open and close to expose groups of electrical contacts within the receptacle 12 as will be explained below. In the embodiment shown, the covers rotate on a common axle pin that is located at the top of the faceplate 20. Each cover 30, 34 can be opened by swinging the cover about the axle pin and outwardly from the faceplate 20. Upon release, the covers are moved by the spring (not shown) to cover a portion of the opening in the front face of the receptacle.

With both the first and second covers 30, 34 positioned in an open position, the receptacle 12 can receive the plug 14 as shown in FIG. 1.

Figure 2:
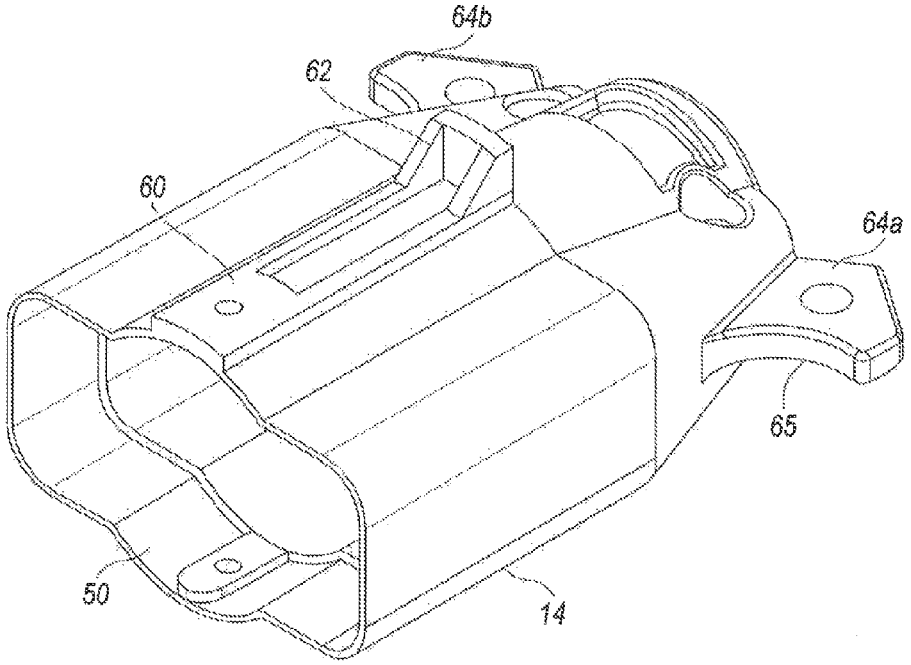
FIG. 2 is an isometric view of a receptacle without electrical contacts installed in accordance with an embodiment of the disclosed technology.
Figure 3:
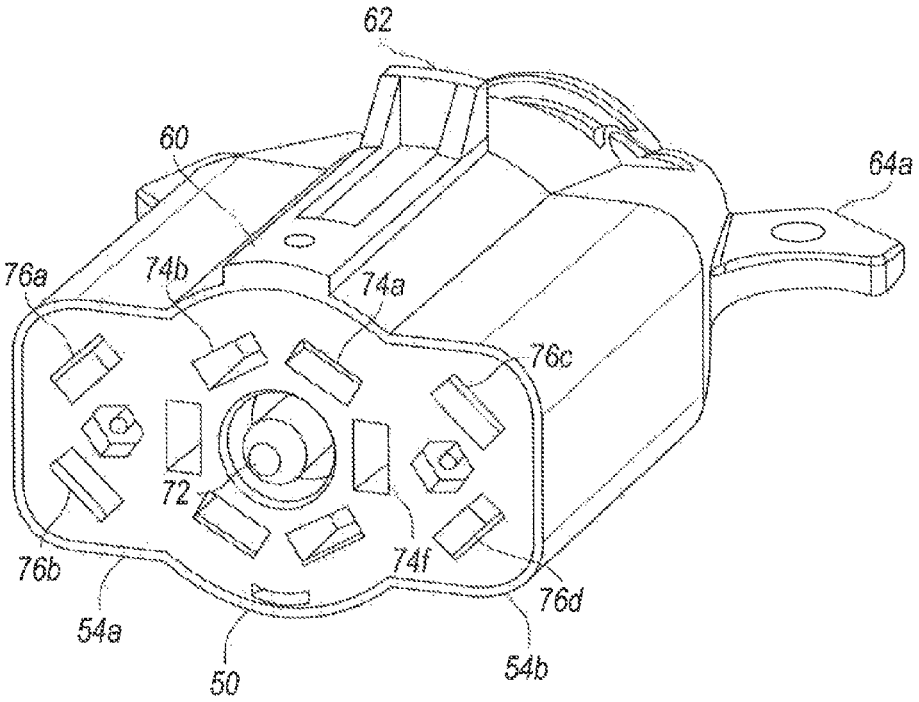
FIG. 3 is an isometric view of a plug with electrical contacts installed.
Figure 4:
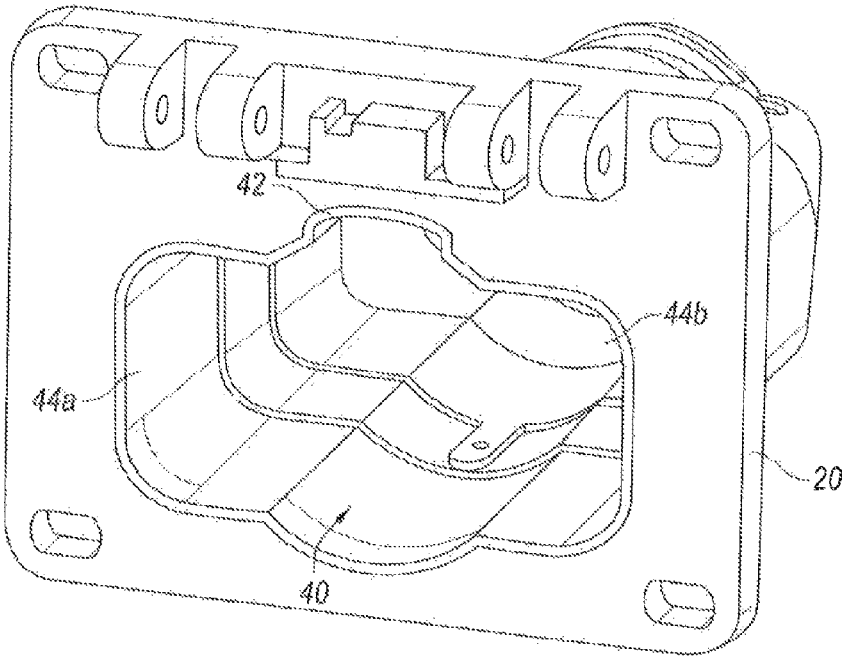
FIG. 4 is an isometric view of a receptacle without electrical contacts installed that mates with the plug shown in FIG. 3.

FIGS. 2 and 3 are isometric views of the plug 14 that fits within the receptacle 12. The plug 14 has a central portion 50 having a partially circular shape with a key 60 positioned on one side that fits into a corresponding keyway 42 on the receptacle (FIG. 4). Within the central portion 50 of the plug are a number of electrical contacts arranged in a conventional seven contact configuration. On either side of the central portion 50 are a pair of generally rectangular extension areas 54*a*, 54*b* having contacts 76*a*-76*d* that mate with corresponding electrical contacts positioned in extension areas 44*a*, 44*b* of the receptacle. In the embodiment shown, the electrical contacts include a center contact 72 and six surrounding electrical contacts 74*a*-74*f* that are positioned in a generally circular configuration around the center contact 72. This configuration of seven electrical contacts is well known in the field of automotive and vehicle power connectors.

The extension areas include additional electrical contacts 76*a*, 76*b* on one side and 76*c* and 76*d* on the other side. In the embodiment shown, the electrical contacts 76*a*-76*d* in the extension areas 54*a*, 54*b* are blade contacts that are oriented at approximately 45 degrees to an imaginary line running vertically and horizontally through the center of the front face of the plug 14.

Aligned with and spaced proximally from the key 60 is an outwardly extending tab 62. The tab is configured to fit behind a corresponding tab (not shown) on the back surface of the cover flap 34. In this manner, the tabs engage and the plug 14 cannot be easily removed from the receptacle 12 until the cover flap 34 is raised to a height sufficient to move the tab on the cover out of the way of the tab 62 on the plug 14.

At the proximal end of the plug 14 are two outwardly extending projections 64*a*, 64*b* having a curved inner surface 65 (FIG. 2) that form a stop against a user's fingers. When a user grasps the plug 14 with their hand, the curved surfaces 65 of the projections 64*a*, 64*b* provide an ergonomic surface for the user's fingers to pull the plug 14 out of the receptacle 12.

FIG. 4 is an isometric view of the receptacle 12 with the covers 30, 34 removed and no electrical contacts in the receptacle. The receptacle has a central opening 40 that is curved on its top and bottom sides into which a cylindrical plug (not shown) can be fitted. The opening has a keyway 42 on one side that receives a corresponding key 60 on a cylindrical plug to prevent the plug from being misaligned when inserted into the receptacle. On either side of the circular opening 40 is a pair of rectangular extension areas 44*a* and 44*b*. The extension areas 44*a* and 44*b* could be referred to as "wings" on either side of the central portion of the opening in the receptacle. The extension areas 44*a* and 44*b* provide access to additional electrical contacts in the receptacle 12.

Figure 5:
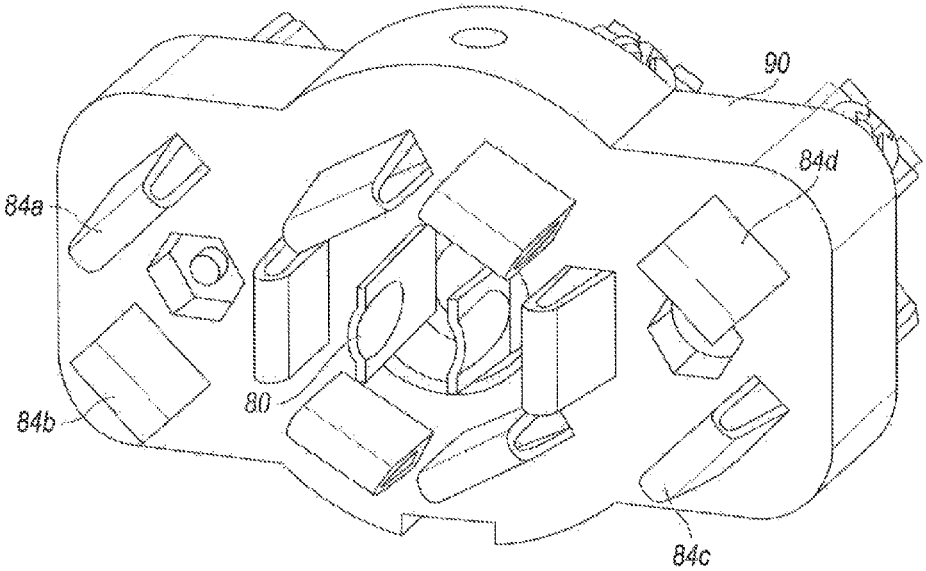
FIG. 5 is an arrangement of electrical contacts that fit within the receptacle shown in FIG. 4.

FIG. 5 shows an arrangement of electrical contacts that fit within the body portion of the receptacle 12 shown in FIG. 4. The electrical contacts include a center pair of center contacts 80 and a number of electrical contacts 82*a*-82*f* that are positioned in a generally circular configuration around the pair of center contacts 80. Additional electrical contacts 84*a*-84*d* are positioned in the extension areas that lie on either side of the circular arrangement of electrical contacts 82*a*-82*f*.

The electrical contacts shown in FIG. 5 are preferably secured in an injection molded insert 90 that is in turn held within the housings of the receptacle and the plug with a set screw, adhesive, over-molding or the like. Alternatively, the receptacle and plug can be molded as one piece with the electrical contacts in place. The housings and other components of the plug assembly can be made of metal, plastic, hard rubber or other materials.

During use, the receptacle 12 is able to receive a conventional cylindrical plug assembly to mate with the standard configuration of electrical contacts 80 and 82*a*-82*f*. The user lifts the outer cover flap 34 and can insert the cylindrical plug through an opening in the second cover flap 30. If the user desires to connect a trailer, RV, boat etc. that requires more electrical power, the user lifts both cover flaps 30, 34 and can insert a plug of the type shown in FIGS. 2 and 3 into the receptacle.

This eleven contact plug described has 60% more capacity allowing consumers and manufactures the ability to add features like ABS brakes, electric audible back up alarms, and locking trailer steer axles while still allowing the use of the existing seven contact plugs.

Figure 6A:
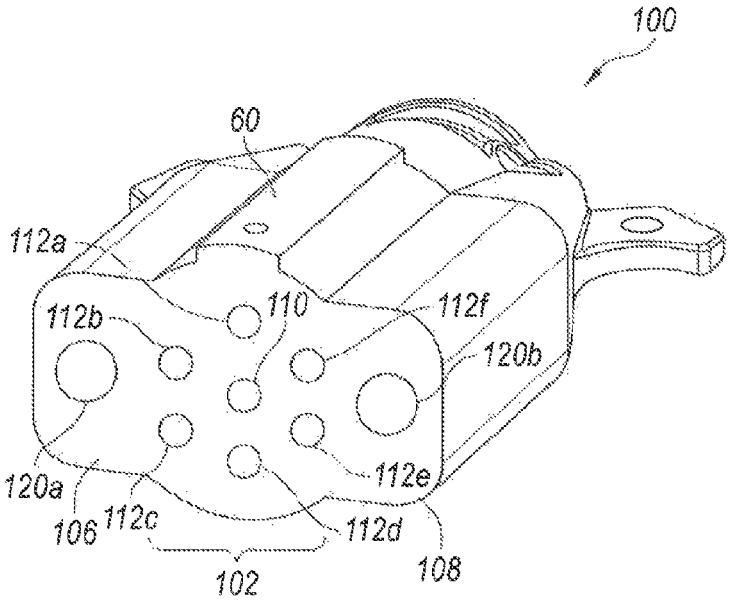
FIGS. 6A and 6B show an alternative embodiment of a vehicle power connector assembly in accordance with the disclosed technology.
Figure 6B:
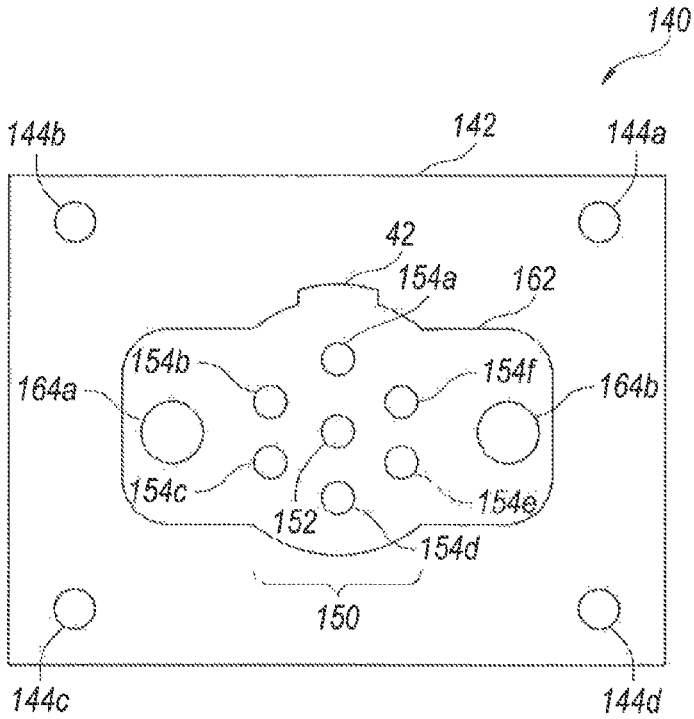

FIGS. 6A and 6B illustrate an alternative embodiment of an electrical plug in accordance with the disclosed technology. The electrical plug 100 includes a central area 102 that is partially circular. At the top of the plug is an optional key 60 that mates with a corresponding keyway on the receptacle to prevent the plug from being inserted in a wrong orientation. In the center area of the plug is a standard configuration of 7 electrical contacts including a center contact 110 and six surrounding contacts 112*a*-112*f*. The plug 100 also includes extension areas 106 and 108 to the sides of the central area 102. In this embodiment, the extension areas each carry a single contact 120*a* and 120*b*. The two extra contacts allow the plug to be used to carry additional power to a trailer etc. In the embodiment shown, the contacts 120*a* and 120 are physically larger than the contacts in the center portion of the plug thereby allowing them to carry more current. However, the contacts can be the same size (or smaller) than the contacts at the center of the plug. In one embodiment, the contacts in the plug 100 are female contacts that accept corresponding male contacts in the receptacle. In another embodiment, the contacts in the plug are male contacts that extend outwardly from a front face of the plug. The electrical contacts can be pins or blade-style (or other style) contacts. This is also true for the embodiment described above and shown in FIG. 5. Although the embodiment shown has an additional contact in each extension area, it is possible that an extension area may not include any additional contacts or that the number of contacts in each extension area may not be the same (e.g. one extension area has two contacts and the other extension area has a single contact).

FIG. 6B shows a front view of the receptacle that receives the plug 100 shown in FIG. 6A. The receptacle 140 includes a faceplate 142 with of holes 144*a*-144*d* in the corners that allow the faceplate to be secured to a vehicle. The faceplate includes an opening with a central area 150 that is partially circular to receive a standard cylindrical plug. The top of the central area includes a keyway 42 that receives the corresponding key 60 on the plug 100. In the center of the receptacle is an arrangement of 7 contacts with a center contact 152 and six surrounding contacts 154*a*-154*f* that mate with the center contacts of a plug 100 as shown in FIG. 6A or a conventional 7-pin vehicle power connector. On either side of the central area 150 is an outwardly extending extension area 160, 162 that holds a corresponding contact 164*a* and 164*b*. These additional contacts mate with the corresponding contacts 120*b*, 120*a* on the plug 100. In one embodiment, the receptacle 140 includes a pair of covers of the type illustrated in FIG. 1 that allow either the central 7 contacts to be exposed or all nine contacts to be exposed depending on the type of plug that is to be inserted into the receptacle.

As will be appreciated, the nine contact connector/receptacle shown in FIGS. 6A and 6B provides additional capability to route power from a vehicle to a trailer or other object that is connected to the vehicle.

Figure 7:
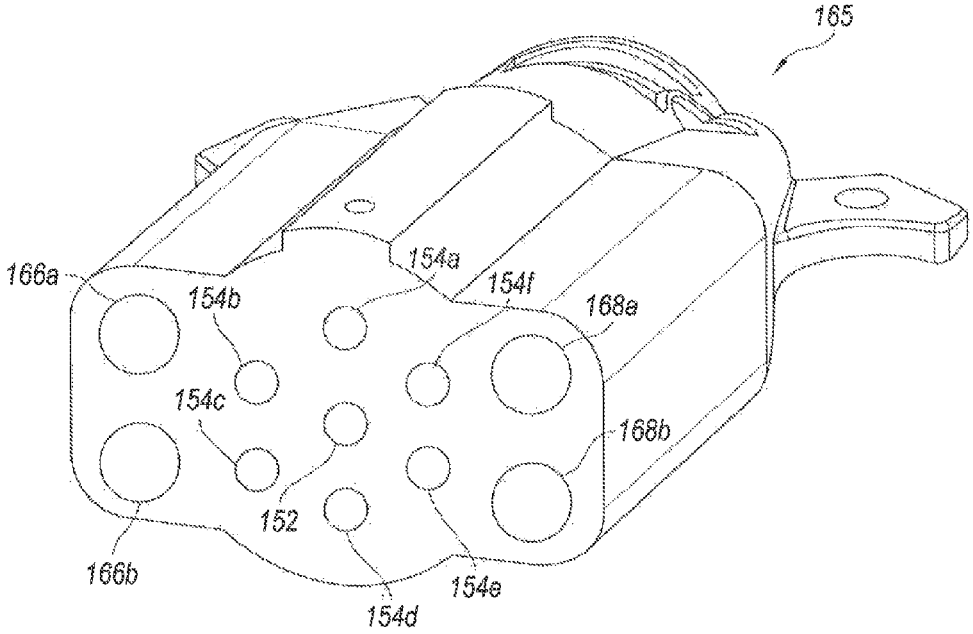
FIG. 7 shows another arrangement of contacts for a vehicle power connector in accordance with an embodiment of the disclosed technology.

FIG. 7 illustrates yet another embodiment of an 11 contact vehicle power connector. In this embodiment, the connector 165 includes a central area with a generally circular arrangement of contacts including a center contact 152 and six surrounding contacts 154*a*-154*f*. In addition, the connector includes lateral extension areas that each contains two additional contacts 166*a*, 166*b* and 168*a* and 168*b*. In this embodiment, the additional contacts are designed to receive cylindrical pins from a correspondingly shaped receptacle (not shown). However blade style contacts could be used or the plug could contain the male contacts that are arranged to mate with corresponding female contacts on the receptacle. The number of contacts that can be placed into the extension areas depends on how much space is available in the extension areas and the size of the contacts.

As will be appreciated, the disclosed technology adds the ability to add more power circuits without using the existing wiring of the vehicle. The design of the plug is such that one could wire it for an external power source like a generator or some other device and do away with the need for extension cords running them from the truck to the trailer or vice versa.

With the amount of extra connections one could wire the plug for 220 Volts, which would allow for the tow vehicle or trailer mounted generator to power up larger voltage equipment like A/C units, welders, and air compressors doing away with the need for large heavy and expensive extension cords.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A power connector for a vehicle comprising:

a receptacle with a central opening that is configured to receive a generally cylindrical plug, wherein the central opening has a center contact and number of electrical contacts that are arranged in a generally circular configuration around the center contact; and an extension area on both sides of the central opening that extends the central opening laterally and that holds one or more additional electrical contacts such that the receptacle is configured to receive a mating plug having a partially cylindrical portion and extension areas on both sides of the partially cylindrical portion with at least one electrical contact that mates with an electrical contact in an extension area of the receptacle.

2. The power connector of claim 1, further comprising:

a first cover that is configured to open and expose the additional contacts; and a second cover that is configured to open and expose the center contact and the surrounding circular configuration of contacts.

3. The power connector of claim 2, wherein the first cover has an opening to receive the generally cylindrical plug into the receptacle with the first cover in a closed position.

4. The power connector of claim 1, wherein the additional electrical contacts in the extension areas are symmetrically arranged about the center contact.

5. The power connector of claim 1, wherein the additional electrical contacts are blades and are oriented at approximately 45 degrees with respect to a vertical and horizontal axis of a front face of the receptacle.

6. The power connector of claim 1, further comprising a plug housing having a cross-sectional shape that fits within the central opening of the receptacle and the extension areas.

7. The power connector of claim 6, wherein the plug has a pair of outwardly extending protrusions that are configured to engage a user's fingers when a user pulls the plug from the receptacle.

8. The power connector of claim 7, wherein the protrusions have curved ergonomic surfaces that engage a user's fingers.

9. The power connector of claim 1, wherein at least one electrical contact in the extension areas is a blade contact.

10. The power connector of claim 1, wherein at least one electrical contact in the extension areas is a pin contact.

11. The power connector of claim 1, wherein at least one electrical contact in the extension areas is rated to handle more current than a contact in the central opening of the receptacle.

12. An electrical power plug for a vehicle comprising:

a body with a partially cylindrical center portion with a center contact and a number of electrical contacts that are arranged in a generally circular configuration around the center contact; and a pair of extension areas that extend laterally outwards from both sides of the partially cylindrical center portion, wherein each extension area includes at least one additional electrical contact;

wherein the plug is configured to mate with a power receptacle of the type having a partially circular central opening with a center contact and number of electrical contacts that are arranged in a generally circular configuration around the center contact; and an extension area on both sides of the central opening that extends the partially circular central opening laterally and that holds one or more additional electrical contacts.

13. The electrical power plug of claim 12, wherein one or more of the electrical contacts are blade style electrical contacts.

14. The electrical power plug of claim 12, wherein one or more of the electrical contacts are pin style electrical contacts.

15. The electrical power plug of claim 12, wherein an electrical contact in the extension area is rated to carry more current than an electrical contact in the partially cylindrical center portion of the plug.

16. An electrical power plug for a vehicle comprising:

a body with a partially cylindrical center portion with a center contact and number of electrical contacts that are arranged in a generally circular configuration around the center contact;

a pair of extension areas that extend outwardly from both sides of the partially cylindrical center portion, wherein each extension area includes at least one additional electrical contact; and a pair of outwardly extending protrusions that are configured to engage a user's fingers when a user pulls the plug from a corresponding power receptacle, wherein the plug is configured to mate with a power receptacle of the type having a partially circular central opening with a center contact and number of electrical contacts that are arranged in a generally circular configuration around the center contact and, an extension area on both sides of the central opening that extends the partially circular central opening radially outwards from the center contact and that holds one or more additional electrical contacts.

17. The electrical power plug of claim 16, wherein one or more of the electrical contacts are blade style electrical contacts.

18. The electrical power plug of claim 16, wherein one or more of the electrical contacts are pin style electrical contacts.

19. An electrical power plug for a vehicle comprising:

a body with a partially cylindrical center portion with a center contact and number of electrical contacts that are arranged in a generally circular configuration around the center contact; and a pair of symmetrically oriented extension areas that extend radially outwardly from both sides of the partially cylindrical center portion, wherein each extension area includes at least one additional electrical contact;

wherein the plug is configured to mate with a power receptacle of the type having a partially circular central opening with a center contact and number of electrical contacts that are arranged in a generally circular configuration around the center contact, and a pair of corresponding symmetrically oriented extension areas on both sides of the central opening that extend the partially circular central opening radially outwards and that hold one or more additional electrical contacts.

20. A power connector for a vehicle comprising:

a receptacle with a central opening that is configured to receive a generally cylindrical plug, wherein the central opening has a center contact and number of electrical contacts that are arranged in a generally circular configuration around the center contact; and an extension area on both sides of the central opening that extends the central opening laterally and that holds one or more additional electrical contacts such that in addition to being configured to receive a generally cylindrical plug, the receptacle is also configured to receive a mating plug having a partially cylindrical portion and extension areas on both sides of the partially cylindrical portion with at least one electrical contact that mates with an electrical contact in an extension area of the receptacle.

* * * * *